United States Patent [19]

Magid

[11] 4,391,062

[45] Jul. 5, 1983

[54] INFLATABLE ARTICLES

[76] Inventor: Sidney H. Magid, 4th Fl., No. 10, Alley 5, La. 12, Section 4, Jen Ai Rd., Taipei, Taiwan

[21] Appl. No.: 276,513

[22] Filed: Jun. 23, 1981

[30] Foreign Application Priority Data

Jun. 1, 1981 [TW] Taiwan ..... 7011599

[51] Int. Cl.[3] ..... A63H 3/06

[52] U.S. Cl. ..... 46/88; 46/47; 273/127 R; 273/129 W

[58] Field of Search ..... 46/88, 87, 90, 47; 273/58 E, 58 F, 129 W, 129 R, 127 R, 127 D

[56] References Cited

U.S. PATENT DOCUMENTS

| | | | |
|---|---|---|---|
| 1,745,576 | 2/1930 | Kempien | 46/88 |
| 2,996,834 | 8/1961 | Berlow | 46/88 |
| 4,309,840 | 1/1982 | Kulesza et al. | 46/87 X |

FOREIGN PATENT DOCUMENTS

| | | | |
|---|---|---|---|
| 2027351 | 2/1980 | United Kingdom | 46/88 |

*Primary Examiner*—Mickey Yu

*Attorney, Agent, or Firm*—Cushman, Darby & Cushman

[57] ABSTRACT

An inflatable article having an inflatable envelope made of a gas impervious material which is at least in part resilient forming a closed surface and provided with at least one inflating valve thereon. At least one hollow protrusion, provided with a closed end and an open end, is attached to the envelope, and at least one movable internal object is contained within the closed surface. One or more restraining elements may be provided on the outer surface of the envelope to keep the inflatable envelope in a restrained condition during use. An internal supporting element, at least in part rigid, is attached to the wall of the closed surface. The inflatable article further includes a control element connected with the closed end of the hollow protrusion and extending externally of the closed surface, and at least one movement imparting element movably mounted on the internal supporting element and associated with the closed end of the hollow protrusion for imparting movement to the internal object when activated by the external control element. Furthermore, within the envelope at least one returning element is associated with the hollow protrusion for returning the hollow protrusion to its original unflexed position after the external force applied by a user for activating the external control element is released.

13 Claims, 13 Drawing Figures

INFLATABLE ARTICLES

BACKGROUND OF THE INVENTION

This invention relates to inflatable articles in which at least one movable internal object can be moved by a movement imparting element associated with an external control element through a flexible hollow protrustion attached to a wall of the inflatable articles. Specifically speaking, this invention relates to further developments of the inventor's prior application, Ser. No. 004,549, filed Jan. 18, 1979, now allowed which is a continuation in part application of a parent application, Ser. No. 907,049, filed May 18, 1978, now abandoned.

The prior application assigned with Ser. No. 004,549 discloses an inflatable article without any restraining elements so that one has to, on the one hand, hold the inflatable article, and on the other hand, operate an external control elelment so as to move the internal object contained in the article. It is not easy to provide further developments for pleasure or entertainment for individuals. In addition, the internal object in the prior application is always connected with the sealed end of the hollow protrusion by means of a non-elastic connection member and it reduces the posibility of variations to the construction within the inflatable article and will reduce the potential of the invention accordingly.

SUMMARY OF THE INVENTION

It is accordingly a main object of the present invention to provide inflatable articies in which one or more internal movable objects could be moved by novel movement imparting elements to increase the potential of this invention for play and other purposes.

It is another object of the present invention to provide inflatable articles in which an internal supporting element is made, at least in part, of rigid materials and is attached to the wall of the inflatable articles. The movement imparting element is movably mounted on the internal supporting element so as to indirectly associatively cooperate with a flexible hollow protrusion provided on the inflatable articles.

It is a further object of the present invention to provide inflatable articles on which one or more restraining elements may be provided so as to restrain the inflatable articles during use.

In accordance with these and many other objects, a preferred embodiment of the present invention comprises an inflatable envelope having one or more internal movable objects therein, at least one inflating valve and one or more restraining elements provided thereon; a hollow protrusion attached to a wall of the envelope and having a closed end and an open end; a substantially rigid internal supporting element attached to the wall of the envelope; an external control element connected with the closed end of the protrusion and extending outwardly of the inflatable envelope; a movement imparting element mounted movably on the internal supporting element and indirectly associated with the hollow protrusion for imparting movement to the internal movable objects; and a returning element associated with the closed end of the hollow protrusion. The closed end of the hollow protrusion can be designed to selectively engage and disengage with the movement imparting element. The hollow protrusion may protrude into or outwardly of the inflatable envelope. The returning element may be positioned within the hollow protrusion or in the inflatable envelope. When the hollow protrusion is protruded into the inflatable envelope, a protrusion housing may be provided within the envelope to cover the inward protrusion so as to avoid the protrusion being undesirably flexed by the gas pressure strored within the envelope.

when the inflatable envelope is kept in a restrained condition by means of the restraining element or restraining forces one may pull the external control element to flex the hollow protrusion so that the movement imparting element associated with the protrustion will be activated to impart movement to the internal movable objects. Upon the external pulling force being released, the hollow protrusion will be returned to its original unflexed position by the returning element.

The movement imparting element described in the present invention can be a pulley, lever, switch, motor, cord with limiting member, cup, or any other pivoted element which can provide a restating motion and impart movement to an object.

The returning element described in the present invention can be an elastic, bellows, spring, the flexible wall of the inflatable envelope, or any other element which will return the hollow protrusion to its original position after the external force applied by the user for activating the external control element is released.

The restraining element described in the present invention can be a suction cup, strap or cord, clamp, band, hanger, protrusion on the outer surface of the inflatable envelope, or any other element provided onto the outer surface of the inflatable envelope which will keep the inflatable article in a restrained condition during use.

Moreover, a limiting member may be provided on a connecting element associated with the movement imparting element and the closed end of the protrusion. The limiting member can prevent the connecting element from disassociating with the movement imparting element when the inflatable envelope is deflated.

The subject resilient material may be PVC, PE, rubber or any other suitable resilient, gas impervious material. The fabrication may be by high frequency heat sealing, direct heat sealing, gluing or any other methods which will provide gas impervious seams.

Many objects and advantages of the present invention will become apparent from considering the following detailed description of preferred embodiments in conjunction with the drawings, in which:

DETAILED DESCRIPTION OF PREFERRED EMBODIMENTS

Figure 1:
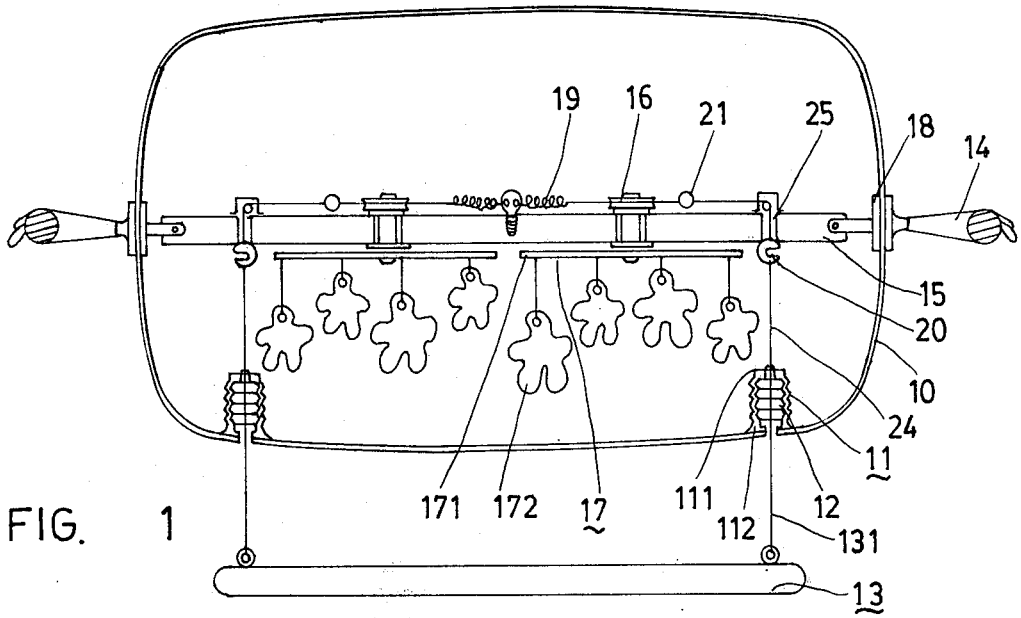
FIG. 1 is a sectional view of the first embodiment according to the present invention.
Figure 2:
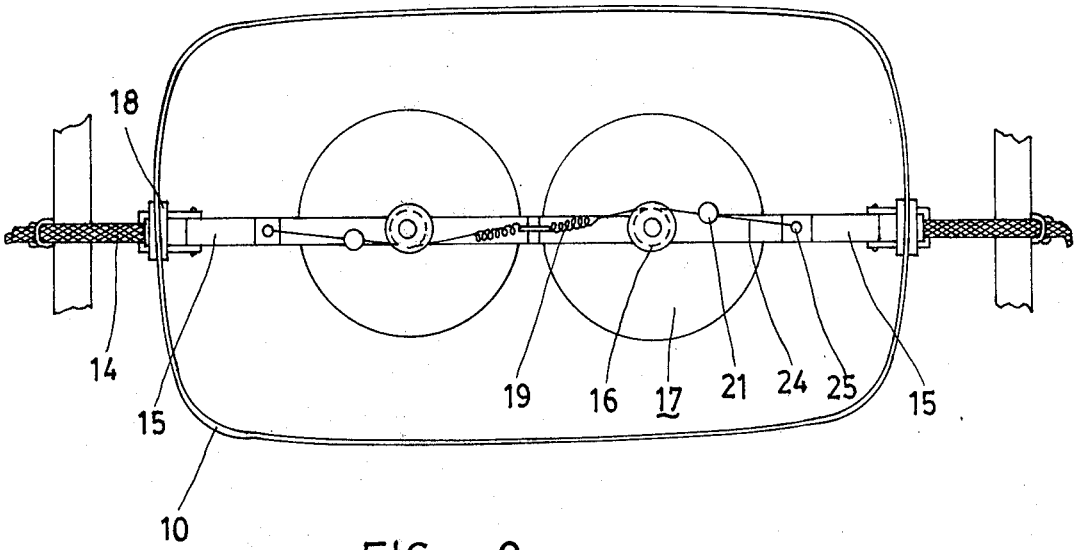
FIG. 2 is a top view of the first embodiment.

Referring now to FIGS. 1 and 2, there is shown the first embodiment of the present invention including an inflatable envelope 10, two inward protruding hollow protrusions 11 containing a bellows 12 therein, an external control element 13, two restraining elements 14 attached to the outer surface of the envelope 10, an internal supporting element 15 pivoted on two fixing members 18 which are attached to the inner wall of the envelope 10, two movement imparting elements 16 mounted on the internal supporting element 15, two internal movable objects 17 connected with the movement imparting elements 16 and consisting respectively of a number of pendants 172 and a disc 171, and returning elements 19 provided on the internal supporting element 15 and associated with the protrusions 11.

The inflatable envelope 10 is preferably provided with one or more inflating valves (not shown in the FIGS. 1 and 2). In this embodiment, the restraining elements 14 are cords which are used to be fastened on an outer object so as to keep the envelope 10 in a restrained condition during use. The external control element 13 has two strings 131 of which one end is connected with the closed end 111 of the protrusion 11, thus, when one pulls the external control element 13, the protrusions 11 will be flexed and contacted against the bellows 12. The purpose of the bellows 12 is to prevent the gas pressure from collapsing the protrusion 11 so that it will not interfere with the smooth action of the external control element and to act as a returning element.

The movement imparting element 16 is a pulley in this embodiment and is associated with the closed end 111 of the protrusion 11 by means of a connecting member 24 such as a string. The connecting string 24 is wound around the pulley 16 and passed through a through-way 25 provided in the internal supporting element 15 to make one end thereof be attached to the closed end 111 of the protrusion 11. The other end of the connecting string 24 is connected with the returning element 19 which is a spring. A stopper 21 is provided on the connecting string 24 and located between the pulley 16 and the through-way 25 of the internal supporting element 12. The size of the stopper 21 is larger than the diameter of the through-way 25 so as to cause the pully 16 to be activated within pre-determined limitations.

The pendants 172 are mounted on the disc 171 which is mounted on the axle of the pulley 16 so that when the pulley 16 is activated by the external control element 13, the disc 171 will be rotated and the pendants 172 will be swung accordingly. When the force applied on the external control element 13 is released, the pully 16 will be rotated in a reversed direction and the protrusion 11 will be returned to its unflexed position by the returning element 19.

To provide further pleasure to the user a bell 20 is provided on the connecting string 24 so that a pleasant sound may be generated during use. The bell 20 is also a limiting member or stopper which with spring 19 prevents the string 24 from disassociating with the pulley 16 when the inflatable envelope 10 is deflated.

Figure 3:
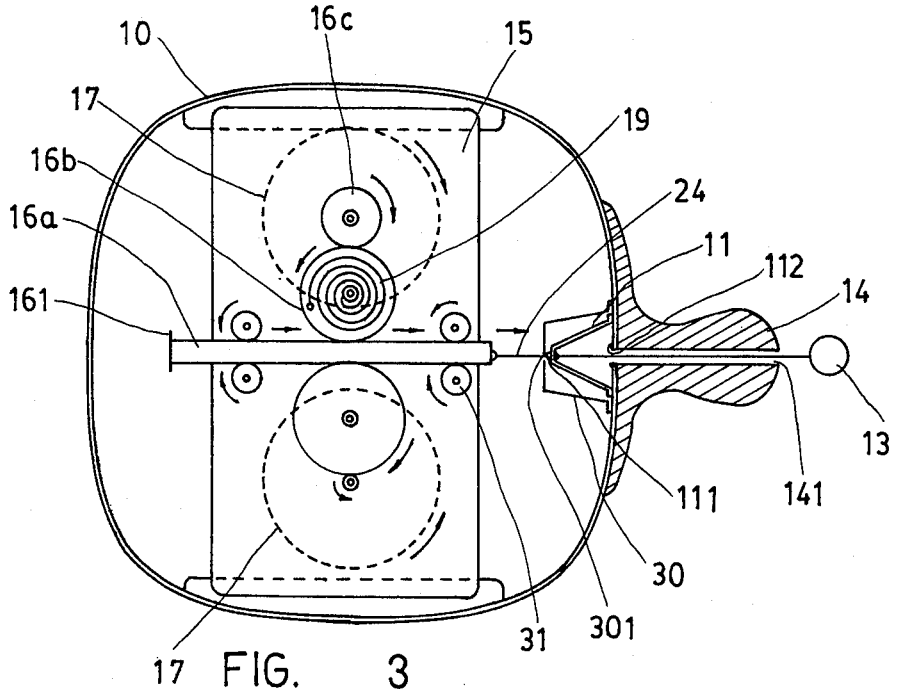
FIG. 3 is a sectional view of the second embodiment according to the present invention.

FIG. 3 shows the second preferred embodiment of the present invention in which the same reference numerals as those used with reference to the first embodiment represent substantially the same elements or members. It should be noted that elements labeled with same reference numeral will work exactly in the same manner. Therefore, for the sake of brevity, only the differences are discussed in detail hereinafter.

An envelope 10 in FIG. 3 has a protrustion 11 protruded inwardly from a wall thereof and having a closed end 111 and an open end 112. A restraining element 14 provided with a through way 141 therein is formed in a handle shape and is attached to the wall of the envelope 10 to opposed the inward protrusion 11 so that an external control element 13 could be connected with the closed end 111 of the protrusion 11 through the through-way 141. A rigid housing 30 with an opening 301 is provided within the envelope 10 to cover the inward protrusion 11 wo as to reduce the gas pressure effected on the protrusion 11.

Mounted on an internal supporting element 15 which is resiliently attached to the inner wall of the envelope 10 are a movable first movement imparting element 16*a*, two second movement imparting elements 16*b* cooperating with the first movement imparting element 16*a*, a third movement imparting element 16*c* cooperating with one of the second movement imparting elements 16*b*, and two internal movable objects 17. Two pairs of small rollers 31 mounted on the internal supportint element 15 are used to support and position the first movement imparting element 16*a*.

In this second embodiment, the first movement imparting element 16*a* is a rod having friction surfaces thereon and a protrusion 161 at the upper end thereof to act as a stopper. By means of a connecting member 24 the lower end of the first movement imparting element 16*a* is connected with the closed end 111 of the protrusion 11. The second movement imparting elements 16*b* are rollers with friction surfaces thereon and are engaged with the first movement imparting element 16*a*. The third movement imparting element 16*c* is also a smaller roller and is engaged with one of the second movement imparting elements 16*b*.

The other second movement imparting element 16*b* is engaged with an axle of one of the internal movable objects 17 which are in a form of disc as described previously so as to make a cooperating relationship therebetween.

As shown in FIG. 3, one end of a spiral flat spring 19 acting as a returning element is mounted fixedly on one of the movement imparting element 16*b* and the other end thereof is mounted on the internal supporting element 15.

Consequently, when one pulls the external control element 13 outwardly, along the directions of arrows shown in FIG. 3, the first movement imparting element 16*a* will be moved downwardly until the protrusion 161 contacting against the upper pair of rollers 31 to activate the second and third movement imparting elements, and the internal movable objects with the spiral flat spring 19 will wind up.

The spiral flat spring 19 in this embodiment acts as a returning element.

Figure 4:
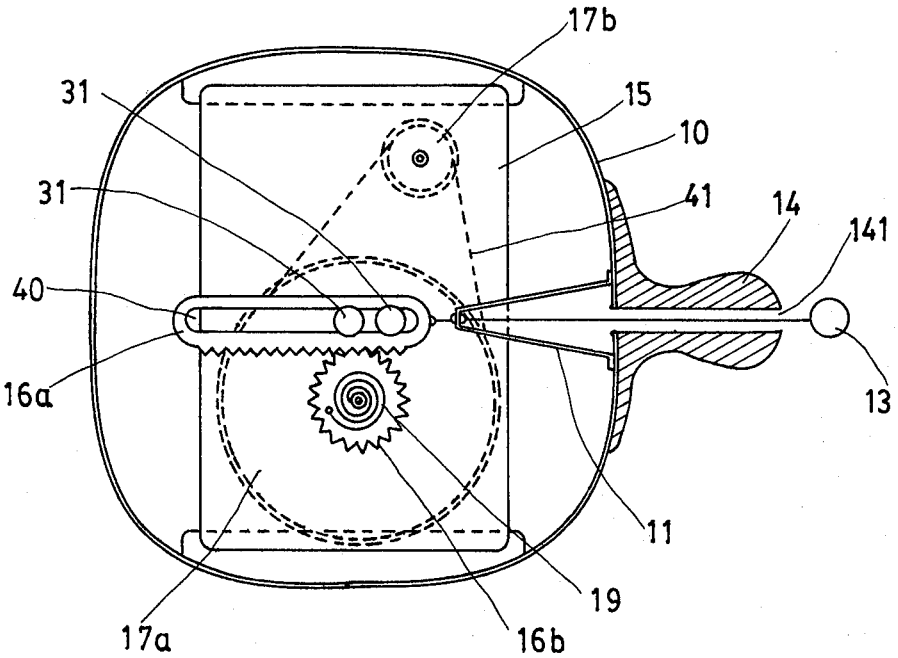
FIG. 4 is a sectional view of the third embodiment according to the present invention.

The third embodiment is shown in FIG. 4 in which the same reference numerals as those used with reference to the second embodiment represent substantialy the same elements or members. In the third embodiment, the first movement imparting element 16*a* is a rack gear and the second movement imparting element 16*b* is a pinion gear. The rack 16*a* has a vertical hollow portion 40 for receiving two pin members 31 mounted on the internal supporting element 15 so that the rack 16*a* can be movably supported on the supporting element 15. One end of the returning element 19 which is also a spiral flat spring is similarly mounted on the supporting element 15 and the other end thereof is fixed on the pinion 16*b* which is engaged with the rack 16*a*. A cord 41 is wound one or more times around the two pulley-like internal movable objects 17*a* and 17*b* and forms a loop. Similarly, one of the movable objects 17*a* and 17*b* is mounted on the axle of the pinion 16*b* and the other movable object is mounted rotatably on the internal supporting element 15. The restraining element 14, the inward protrusion 11 and the external control element 13 are exactly the same as those shown and described in the second embodiment.

Figure 5:
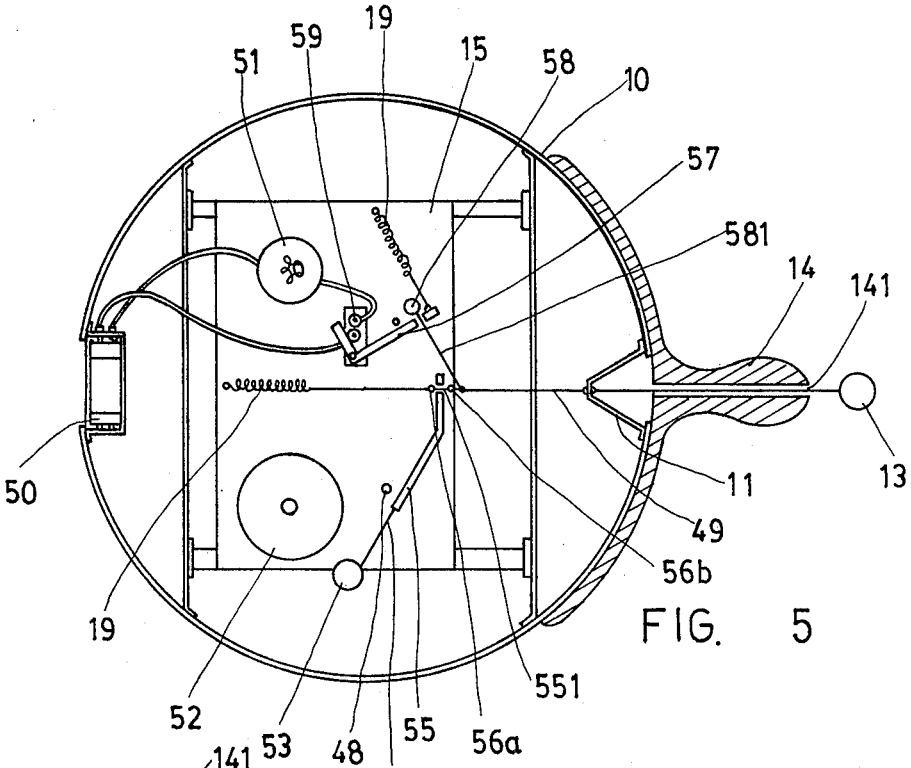
FIG. 5 is a sectional view of the fourth embodiment according to the present invention.

Referring to FIG. 5 there is shown the fourth embodiment in which the same reference numerals as those used with reference to the second embodiment represent substantially the same elements or members. A rigid housing is attached to the envelope 10 for receiving a D.C. power supply and a bulb 51 connected to the power supply is mounted on an internal supporting element 15. A bell 52 and a knife switch 59, which is connected to the power supply 50 to control the power to the bulb 51, are also mounted on the supporting element 15.

A hammer acting as a movable object consists of a hammer head 53 and a flexible member 54 which is connected with one end of a lever 55 pivoted on the internal supporting element 15. The other end of the lever 55 is provided with a through hole 551 therein for permitting a cord 49 to pass therethrough. The upper end of the cord 49 is connected to the lower end of a spring 19 acting as a returning element and the lower end of the cord 49 is attached to the closed end of the protrusion 11. Two stoppers 56*a* and 56*b* are provided on the cord 49 and are located respectively above and below the through-hole 551 of the lever 55. Above the upper end of the lever 55, a stopper 48 is provided on the internal supporting member 15. The restraining element 14, the inward protrusion 11 and the external control element 13 are exactly the same as those shown and described in the second embodiment so that when one pulls the external control element 13, through the through-way 141 of the restraining element 14 and the protrusion 11, the lower end of the lever 55 will be moved downwardly until the upper end thereof contacts against the stopper 48 which causes the flexible member 54 to swing and make the hammer head 53 collide with the bell 52.

Similarly, another lever 57 is pivotally mounted on the internal supporting element 15 and has a through hole 571 at the lower end thereof. The lower end of the lever 57 is connected with a spring 19 acting as another returning element which is mounted on the supporting element 15. The upper end of the lever 57 engages with the knife switch 59. A ball type member 58 with a cord 581 which, through the through hole 571 of the lever 57, is connected with the cord 49 is provided. The diameter of the ball type member 58 is larger than that of the through hole 571 so that when one pulls the external control element 13, the upper end of the lever 57 will be moved to close the knife-switch 59 to light the bulb 51. By means of springs 19, the levers 55 and 57 and the protrusion 11 will be returned to their original position after the external control force is released, and thus, the bulb 51 is extinguished.

Figure 7:
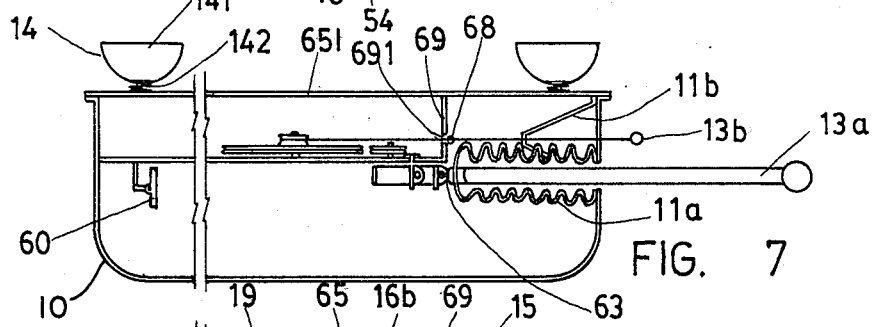
FIG. 7 is a vertical sectional view of the fifth embodiment.
Figure 6:
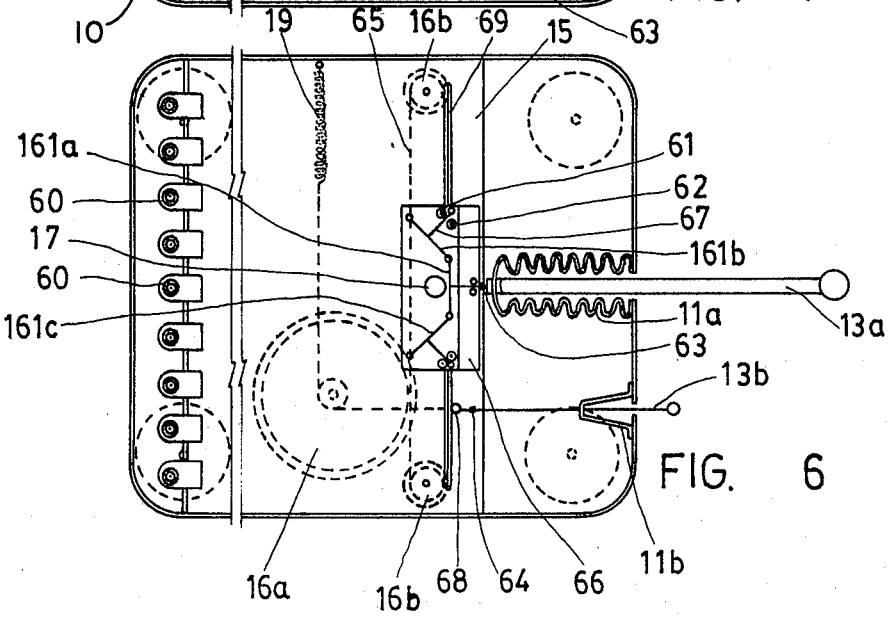
FIG. 6 is a horizontal sectional view of the fifth embodiment according to the present invention.

FIGS. 6 and 7 show the fifth embodiment which is preferrably positioned in a horizontal condition with a slight inclination during use.

In this embodiment the envelope 10 is positioned on a rigid base 651 and, the restraining elements 14 provided at the bottom of the base 651 consist of a suction cup 141 and a spring member 142 for adjusting the inclination of the envelope 10 during use.

There are two external control elements 13*a*, 13*b* and two inward protrusions 11*a* and 11*b* in the fifth embodiment. A cord 64 is wound around the axle of a pulley 16*a*, which is mounted on the internal supporting element 15 and acts as a first movement imparting element. Ends thereof are respectively attached to the closed end of the protrusion 11*b* and a spring 19 acting as a returning element. A stopper 68 is provided on the cord 64 and located below a through hole 691 of a plate 69 mounted on the internal supporting element 15. The diameter of the stopper 68 is larger than that of the through hole 691 so as to prevent the cord 64 from disassociating with the axle of the pulley 16*a* when the inflatable envelope is deflated. Another cord 65 is wound around the pulley 16*a* and two small pulleys 16*b*, which are mounted on the supporting element 15 and acted as second movement imparting elements, to form a loop. A rigid plate 66 acting as a movable object is provided on the cord 65 between the two small pulleys 16*b* so that the rigid plate 66 can be moved leftwardly or rightwardly by the association between returning force of the spring 19 and the external force applied on the external control element 13*b*. Three third movement imparting elements 161*a*, 161*b* and 161*c* are provided on the rigid plate 66 to form a space for receiving a ball 17 acting as an internal movable object. The middle portion of each of the third movement imparting elements 161*a*, 161*b*, and 161*c* are connected with a non-elastic connecting member 67 which are positioned slidably between a pair of rollers 61 and 62 mounted on the rigid plate 66. The lower end of each of the rigid connecting members 67 is provided with a ring member 671 for engaging with a hook or engaging member 63 associated with the closed end of the protrusion 11*a*, whereby operating the external control element 13*a*, the closed end of the protrusion 11*a* can be selectively connected with any one of the third movement imparting elements 161*a*, 161*b*, and 161*c* through the non-elastic connecting member 67 and the hook or engaging member 63.

By the elasticity of the third movement imparting elements 161*a*, 161*b*, and 161*c*, the movable ball 17 can be propelled by any one of the said third movement imparting elements which is selectively connected with the closed end of the protrusion 11*a*.

Provided at the top portion of the envelope 10 are a number of targets 60. Consequently, a user may use one hand to operate the external control element 13*b* to move the rigid plate 66 to a desired position, and use another hand to operate the external control element 13*a* to propel the ball 17 to an aimed target 60.

After the movable ball 17 is propelled, the user may press alternatively one of the springs 142 to move the ball back into the space defined by the third movement imparting elements.

Figure 8:
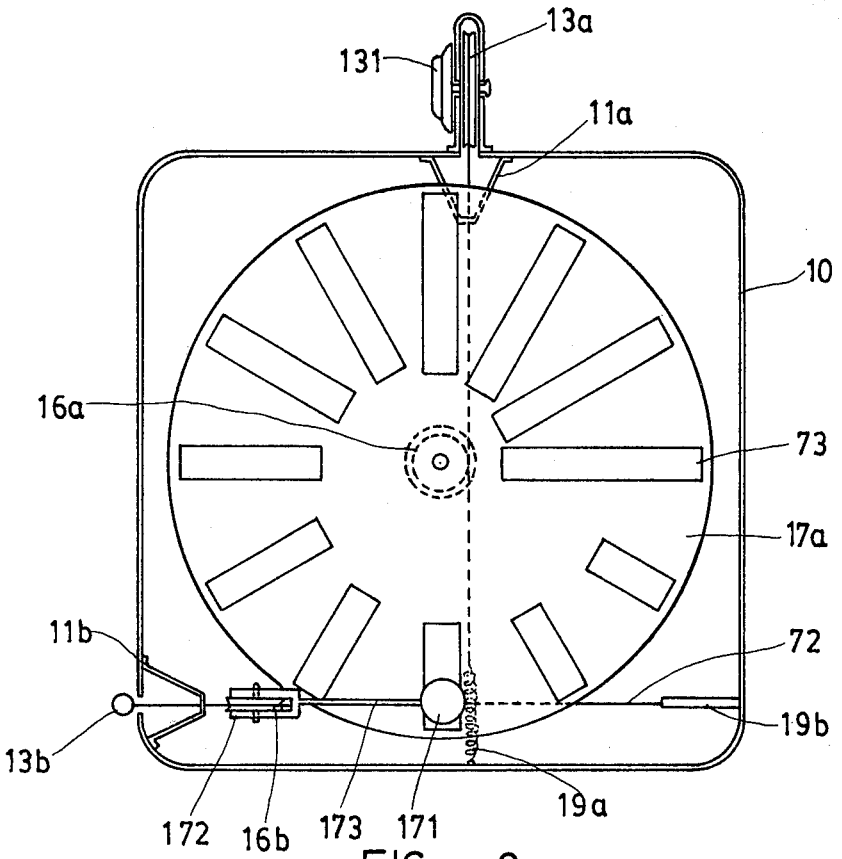
FIG. 8 is a horizontal sectional view of the sixth embodiment according to the present invention.
Figure 9:
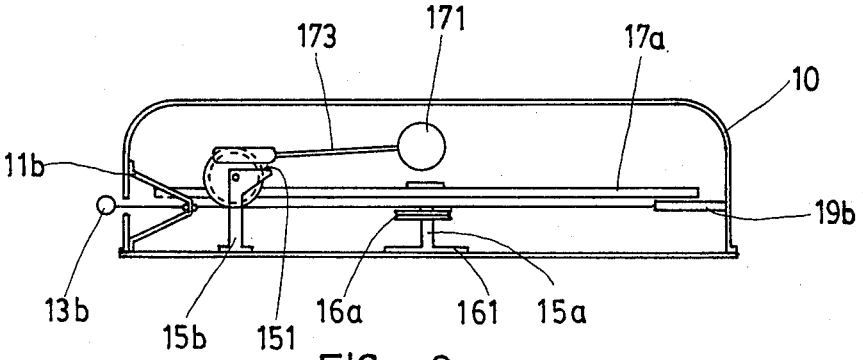
FIG. 9 is a vertical sectional view of the sixth embodiment.

The sixth embodiment is illustrated in FIGS. 8 and 9 in which the internal movable objects are a large disc 17*a* on which a number of sound generating plates 73 are provided, and hammer 17 which is mounted fixedly on a pulley 16*b* acting as a movement imparting element. The hammer 17 consists of a hammer head 171, a base 172 connected with the pulley 16*b*, and a flexible member 173 for connecting with the hammer head 171 and the base 172. As clearly shown in FIG. 9, the disc 17*a* is fixed on the axle of the pulley 16*a* which is mounted on a shaft 15*a* acting as an internal supporting element. The pulley 16*b* with a flange 161 is mounted on an another internal supporting element 15*b* which has a stopper 151 to stop the clockwise movement of the pulley 16*b*.

A cord 70 is wound around the pulley 16*a* and ends thereof are connected with the closed end of the protrusion 11*a* and one end of a spring 19*a* which acts as a returning element and is attached to the envelope 10. Another cord 72 is similarly wound around the pulley 16*b* and its ends are connected with the closed end of the protrusion 11*b* and to one end of an elastic 19*b* respectively. In this embodiment, the external control element 13*a* is a calibrated device upon which a number of calibrations correspond to the sound generating plates 73 provided on the disc 17*a*, so that turning a dial 131 of the calibrated device 13*a* can move a desired sound generating plate to a position under the hammer head 171. Although no restraining element is provided, a restraining force is provided by the hand of the user which is positioned on the inflatable envelope 10.

Figure 11:
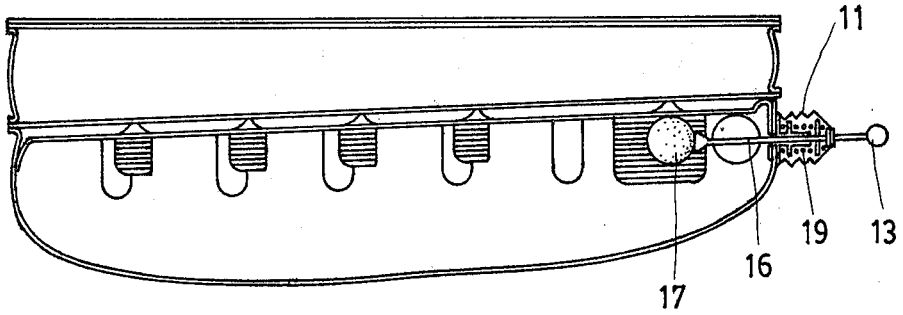
FIG. 11 is a vertical sectional view of the seventh embodiment.
Figure 10:
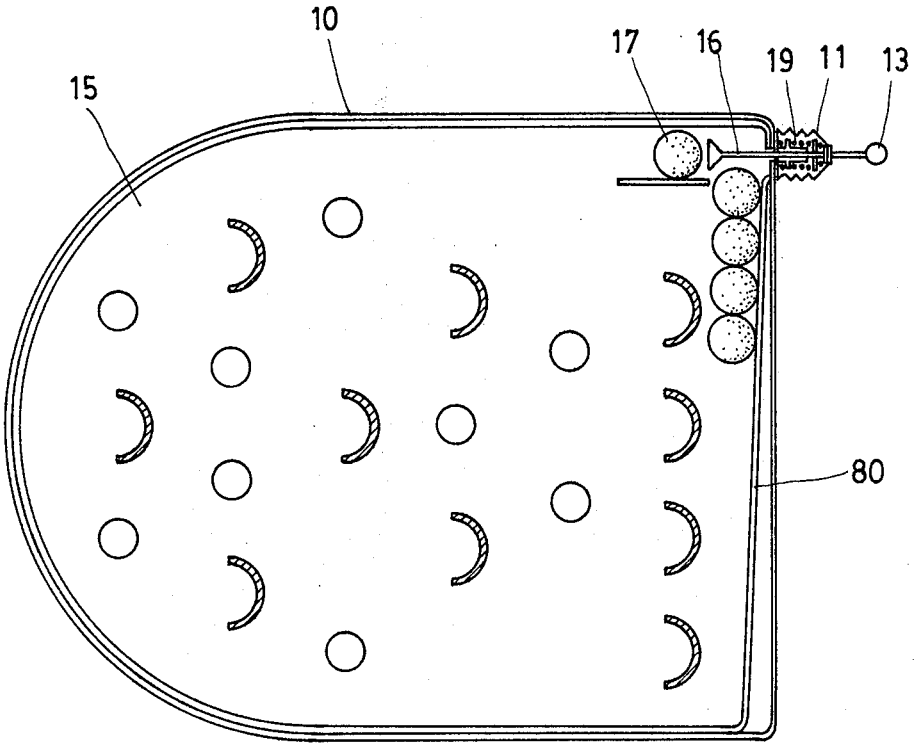
FIG. 10 is a horizontal view of the seventh embodiment according to the present invention.
Figure 12:
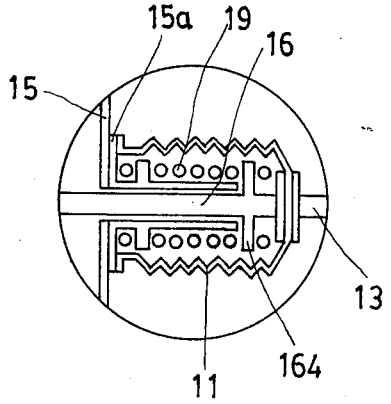
FIG. 12 is an enlarged sectional view of the outwardly protruded protrusion with a returning element taken from FIGS. 10 and 11.

The seventh embodiment shown in FIGS. 10 to 12 is embodied by a pin ball machine, in which the protrusion 11 protrudes outwardly and the returning element 19 is provided within the outward protrusion 11. The lower end of a rod 16 acting as a movement imparting element is connected with the closed end of the outward protrusion 11. As clearly shown in FIG. 12, the returning element 19 is a compression spring, the upper end of which is mounted on a guide 15*a* which is attached to an internal supporting element 15, and the lower end of which is fixed by a flange 164 of the rod 16. An inclined guiding plate 80 is provided at the lower portion of the envelope 10 as shown in FIG. 10 to receive and guide the balls acting as movable objects to move to a predetermined position one by one.

This embodiment is also restrained by a restraining force similar to the one described in the sixth embodiment above.

Thus, when one pulls the external control element 13, the flexible protrusion 11 and the compression spring 19 will be extended and the rod 16 will be moved downwardly to receive a ball at its upper end. When the external force is released, the returning forces of the protrusion 11, the spring 19 and the rod 19 will give movement to the ball at the upper end of the rod 19 so that the ball will be propelled.

Figure 13:
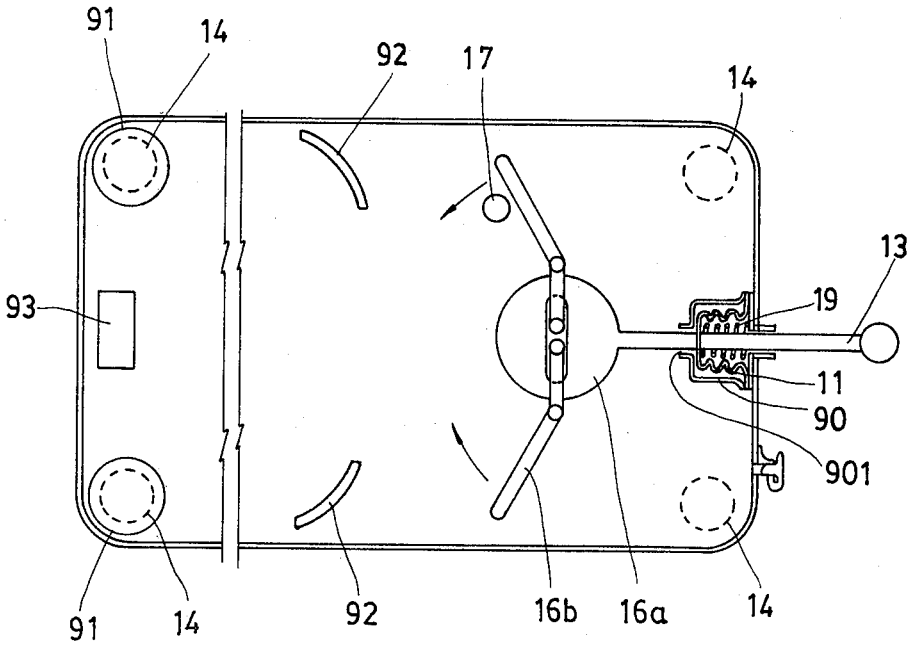
FIG. 13 is a sectional view of the eighth embodiment according to the present invention.

FIG. 13 shows the eighth embodiment which in use is preferrably positioned in a slightly inclined position by suction cups 14 acting as restraining elements. In this embodiment, the protrusion 11 is protruded inwardly from the envelope 10 and is covered by a rigid housing 90 having an opening 901 thereon. The first movement imparting element 16*a* is a cam having a slot 161 thereon and is connected, through the opening 901 of the housing 90, with the closed end of the protrusion 11.

The second movement imparting elements 16*b* are a pair of pivoted levers 16*b*, and are mounted on the internal supporting element 15. A part of one of the pivoted levers 16*b* is movably received in the slot 161 so that when one pulls the external control element 13 the other pivoted lever will be moved along an arrow direction shown in FIG. 13 that may impart movement to a ball 17 acting as an internal object. The envelope 10 is preferrably formed in a rectangular shape in which four bouncing members 91, and 92 made of semi-elastic materials are provided. A goal member 93 is located between the upper bouncing members 91. By operating the external control element 13, the ball 17 may be propelled by the levers 16*b*, and then bounced on the bouncing members 91 and 92 to hit the goal member 93.

It is to be understood that the invention is not limited in its application to the details of construction and arrangement of elements illustrated in the accompanying drawings, since the invention is capable of other embodiments and being practiced or carried out in various ways. Also it is to be understood that the phraseology or terminology employed herein is for the purpose of description and not of limitation.

I claim:

1. An inflatable article comprising:

an inflatable envelope made of a gas impervious material which is at least in part resilient and has at least one inflating valve provided thereon;

at least one flexible hollow protrusion attached to a wall of said envelope, said hollow protrusion having a closed end and an open end;

at least one external control element connected with the closed end of said hollow protrusion and extending outwardly from said hollow protrusion so that said protrusion can be flexed from a normally unflexed position by an external force, applied by a user, to activate said external control element;

an internal supporting element attached to the wall of said envelope;

an engaging member provided on said closed end of said hollow protrusion;

at least one movement imparting element capable of being selectively engaged and disengaged with the closed end of said hollow protrusion by means of said engaging member;

at least one internal movable object contained in said envelope, said movable object being movable by said movement imparting element;

one or more returning elements associated with said hollow protrusion for returning said hollow protrusion to its unflexed position after said external force is released.

2. An inflatable article comprising:

an inflatable envelope made of a gas impervious material which is at least in part resilient and has at least one inflating valve provided thereon;

at least one flexible hollow protrusion attached to a wall of said envelope, said hollow protrusion having a closed end and an open end;

at least one external control element connected with the closed end of said hollow protrusion and extending outwardly from said hollow protrusion so that said protrusion can be flexed from a normally unflexed position by an external force, applied by a user, to activate said external control element;

an internal supporting element attached to the wall of said envelope;

at least one movement imparting element mounted for rotation, relative to and on said internal supporting element;

means for transmitting a linear movement of said closed end of said hollow protrusion to drive said movement imparting element to rotate;

at least one internal movable object contained in said envelope, said movable object being movable by said movement imparting element;

one or more returning elements associated with said hollow protrusion for returning said hollow protrusion to its unflexed position after said force is released.

3. An inflatable article as claimed in claims 1 or 2 wherein said internal movable object is separate from said movement imparting element.

4. An inflatable article as claimed in claim 1 or 2 wherein said external control element is, at least in part, rigid.

5. An inflatable article according to claims 1 or 2, further comprising one or more restraining elements provided on the outer surface of said envelope for restraining the movement of said inflatable article.

6. An inflatable article as claimed in claim 1 wherein said internal supporting element is, at least in part, flexible.

7. An inflatable article according to claim 1 wherein said movement imparting element includes a connecting element thereof for attachment with said engaging member.

8. An inflatable article as claimed in claim 7 wherein said connection element is associated with said closed end of said hollow portion and said returning element.

9. An inflatable article according to claim 2 wherein said movement imparting element comprises an element pivoted for rotation.

10. An inflatable article according to claim 9 wherein said pivoted element is pivoted off center.

11. An inflatable article according to claim 2 wherein said transmitting means includes a connecting element associated with said movement imparting element and said closed end of said protrusion.

12. An inflatable article as claimed in claim 11 wherein said connecting element is associated with said closed end of said hollow portion and said returning element.

13. An inflatable article as claimed in claims 11 or 7 wherein one or more limiting members are provided on said connecting element associated with said movement imparting element and the closed end of said protrusion, said limiting members being used to prevent said connecting element from disassociating with said movement imparting element when said inflatable envelope is deflated.

* * * * *